US005632519A

United States Patent [19]

Stock

[11] Patent Number: 5,632,519

[45] Date of Patent: May 27, 1997

[54] RETRACTABLE POLE FOR HANGING OBJECTS

[76] Inventor: Richard A. Stock, 638 Blueridge Rd., Pittsburgh, Pa. 15239

[21] Appl. No.: 595,646

[22] Filed: Feb. 2, 1996

[51] Int. Cl.[6] ..... A47F 13/06; B25J 1/00

[52] U.S. Cl. ..... 294/19.1

[58] Field of Search ..... 294/19.1, 22, 23, 294/24, 85; 248/317, 339, 340, 343, 544

[56] References Cited

U.S. PATENT DOCUMENTS

| | | | |
|---|---|---|---|
| 3,032,362 | 5/1962 | Lovejoy | 294/19.1 |
| 3,327,376 | 6/1967 | Freeman et al. | 294/19.1 X |
| 3,868,136 | 2/1975 | Schweitzer | 294/19.1 |
| 4,225,108 | 9/1980 | Jaroche | 294/19.1 X |
| 4,970,921 | 11/1990 | Fagan | 294/19.1 X |
| 5,052,733 | 10/1991 | Cheung et al. | 294/19.1 |
| 5,224,745 | 7/1993 | Howell | 294/19.1 |
| 5,267,764 | 12/1993 | Hoffman et al. | 294/19.1 |

*Primary Examiner*—Johnny D. Cherry

[57] ABSTRACT

A hang-up including a sleeve that has a top end with an opening, a bottom end that is sealed, and a slot spaced from the bottom end. Included is a holder that has a pair of sides with a gap. The holder is fixedly attached to the sleeve adjacent the top end, and capable of allowing a hanger to be inserted. A lift rod is positioned within the sleeve and has a lever that is positioned through the slot. The lever moves the lift rod and has a top edge that extends beyond the opening. Lastly, a push tip is fixedly attached to the top edge of the lift rod and lifts a tile of a tile ceiling, when the sleeve is raised. The push tip allows the hanger to be positioned between a metal track of the tile ceiling.

9 Claims, 3 Drawing Sheets

FIG. 1

RETRACTABLE POLE FOR HANGING OBJECTS

BACKGROUND OF THE INVENTION

1. Field of the Invention

The present invention relates to a RETRACTABLE POLE FOR HANGING OBJECTS and more particularly pertains to hanging articles from an overhead ceiling structure through the use of a push tip and a holder positioned to be operatively associated with the top end of the tube.

2. Description of the Prior Art

The use of an extension rod is known in the prior art. More specifically, extension rods heretofore devised and utilized for the purpose of positioning objects above ground are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,333,422 to Warren and Brandt discloses a lightweight extendable and retractable pole. U.S. Pat. No. 5,099,539 to Forester discloses a telescoping extension rod having pivotally adjustable tool head. U.S. Pat. No. 4,863,204 to Peters discloses an article handling tool. U.S. Pat. No. 4,539,927 to Foresman discloses a telescoping pole. U.S. Pat. No. 4,508,467 to Choffin discloses a telescopically extendable pole. Lastly, U.S. Pat. No. 3,429,452 to Johnson discloses a telescoping support rod having universal end cap.

While these devices fulfill their respective, particular objectives and requirements, the aforementioned patents do not describe a hang-up that allows a user, while standing on the ground, to hang articles from the metal track of a tile ceiling structure.

In this respect, the hang-up according to the present invention substantially departs from the conventional concepts and designs of the prior art, and in doing so provides an apparatus primarily developed for the purpose of hanging articles from an overhead ceiling structure through the use of a push tip and a holder positioned to be operatively associated with the top end of the tube.

Therefore, it can be appreciated that there exists a continuing need for a new and improved hang-up which can be used for hanging articles from an overhead ceiling structure through the use of a push tip and a holder positioned to be operatively associated with the top end of the tube. In this regard, the present invention substantially fulfills this need.

SUMMARY OF THE INVENTION

In view of the foregoing disadvantages inherent in the known types of extension rods now present in the prior art, the present invention provides an improved hang-up. As such, the general purpose of the present invention, which will be described subsequently in greater detail, is to provide a new and improved hang-up and method which has all the advantages of the prior art and none of the disadvantages.

To attain this, the present invention essentially comprises an elongated cylindrical sleeve. The sleeve has a top end, a bottom end and a circular cross section. The top end of the sleeve has an opening. The bottom end of the sleeve is sealed. The sleeve has an oblong slot that is spaced from the bottom end and along one side of the sleeve. Also, a generally rectangular holder is provided. The holder has a pair of sides with a base member interconnecting the sides.

The holder is fixedly attached to the sleeve adjacent the top end. The holder is positioned on another side of the sleeve, 45 degrees from the one side that has the slots. The holder is capable of having a hanger with a string inserted therein to lift the hanger above the head of a user of the sleeve. An elongated lift rod is slidably positioned within the sleeve. The lift rod has a lever fixedly attached. The lever is positioned through the slot of the sleeve. The lever is capable of moving the lift rod up and down within the sleeve. The lift rod has a top edge that is capable of extending beyond the opening of the sleeve when the rod is slid up and down within the sleeve. Additionally, a push tip that has a spherical end is fixedly attached to the top edge of the lift rod. The push tip is capable of lifting a tile of a tile ceiling when the sleeve with the rod therein is raised. The push tip lifts the tile to allow the positioning of the hanger between a metal track of the tile ceiling. The push tip is capable of being retracted within the sleeve when the lever is released to allow the tile to return to be repositioned against the metal track for holding the hanger. Lastly, an end cap is positioned over the bottom end of the sleeve. The end cap is for grappling by the hand of a user when turning the sleeve for placement of the hanger onto the metal track.

There has thus been outlined, rather broadly, the more important features of the invention in order that the detailed description thereof that follows may be better understood and in order that the present contribution to the art may be better appreciated. These are, of course, additional features of the invention that will be described hereinafter and which will form the subject mattes of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hang-up which has all of the advantages of the prior art extension rods and none of the disadvantages.

It is another object of the present invention to provide a new and improved hang-up which may be easily and efficiently manufactured and marketed.

It is further object of the present invention to provide a new and improved hang-up which is of durable and reliable constructions.

An even further object of the present invention is to provide a new and improved hang-up which is susceptible of a low cost of manufacture with regard to both materials and labor, and which accordingly is then susceptible of low prices of sale to the consuming public, thereby making such hang-up economically available to the buying public.

Still yet another object of the present invention is to provide a new and improved hang-up which provides in the apparatuses and methods of the prior art some of the advantages thereof, while simultaneously overcoming some of the disadvantages normally associated therewith.

Even still another object of the present invention is to provide a hang-up for hanging articles from an overhead ceiling structure through the use of a push tip and a holder positioned to be operatively associated with the top end of the tube.

Lastly, it is an object of the present invention to provide a new and improved hang-up including a sleeve that has a top end with an opening, a bottom end that is sealed, and a slot spaced from the bottom end. Included is a holder that has a pair of sides with a gap. The holder is fixedly attached to the sleeve adjacent the top end, and capable of allowing a hanger to be inserted. A lift rod is positioned within the sleeve and has a lever that is positioned through the slot. The lever moves the lift sod and has a top edge that extends beyond the opening. Lastly, a push tip is fixedly attached to the top edge of the lift rod and lifts a tile of a tile ceiling, when the sleeve is raised. The push tip allows the hanger to be positioned between a metal track of the tile ceiling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
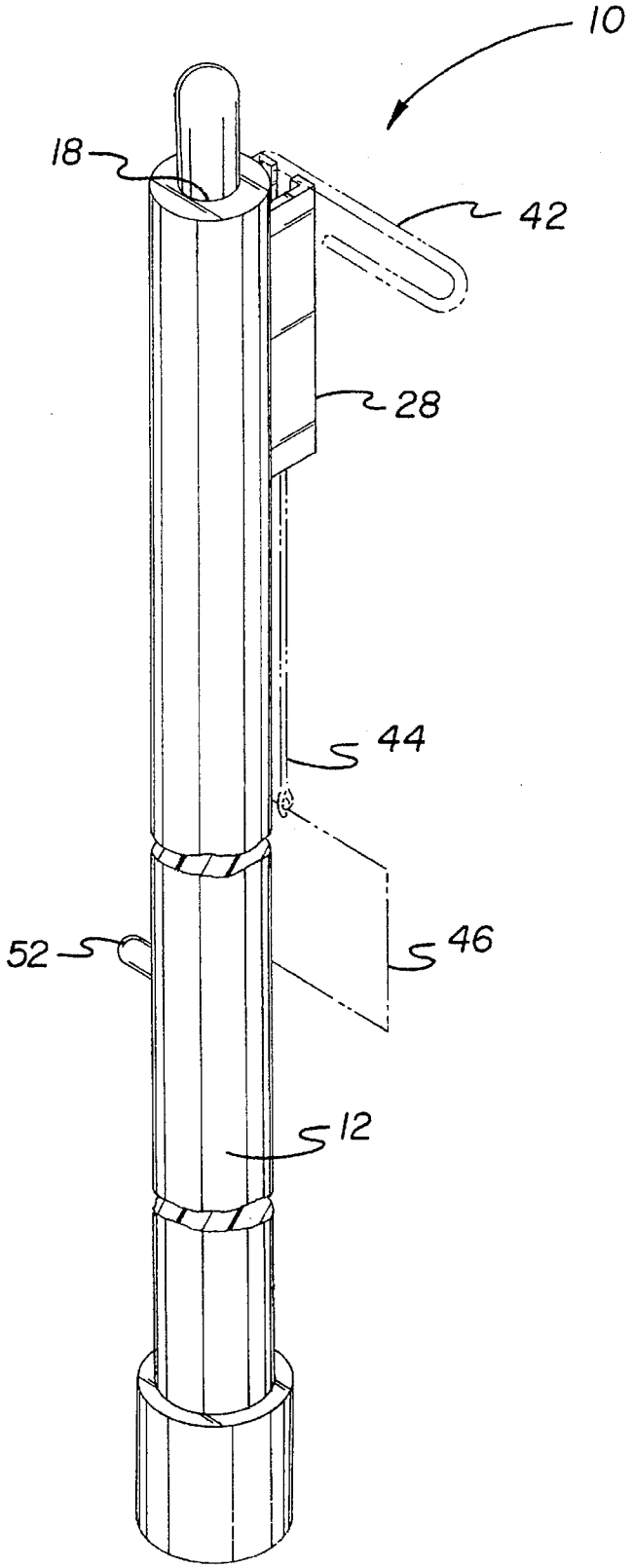
FIG. 1 is a perspective view of the preferred embodiment of the hang-up constructed in accordance with the principles of the present invention.

With reference now to the drawings, and in particular to FIG. 1 thereof, the preferred embodiment of the new and improved hang-up embodying the principles and concepts of the present invention and generally designated by the reference numeral 10 will be described.

The present invention, the hang-up 10, is comprised of a plurality of components. Such components in their broadest context include a sleeve, a holder and a lift rod. Such components are individually configured and correlated with respect to each other so as to attain the desired objective.

Figure 4:
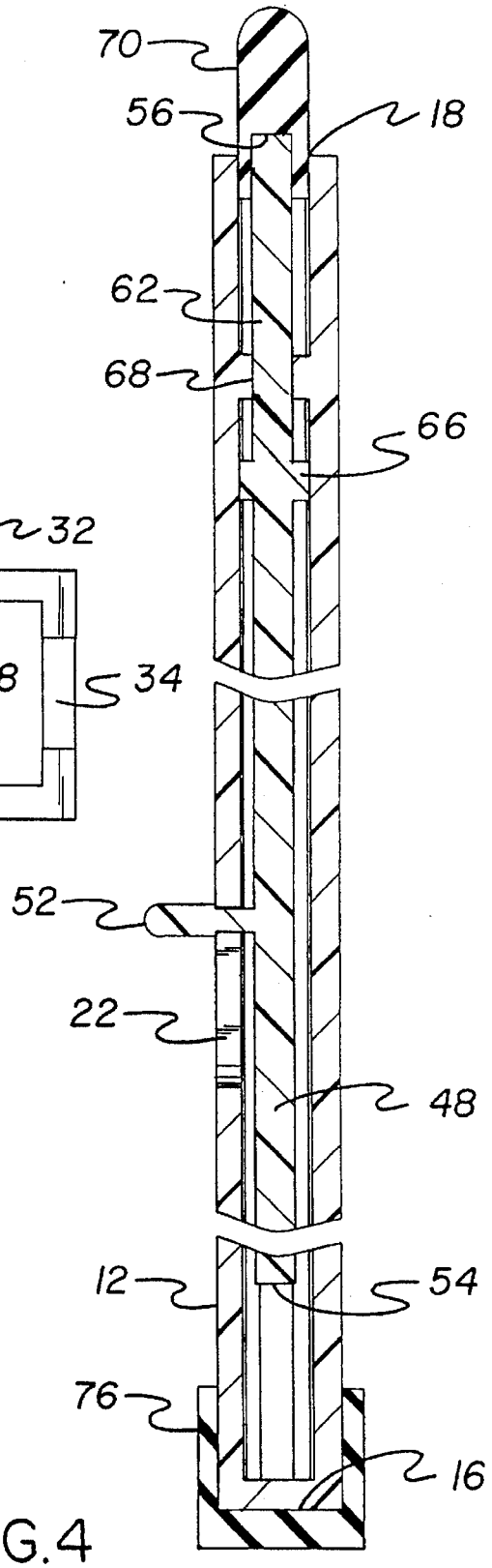
FIG. 4 is a cross sectional vertical view of the present invention taken along line 4—4 of FIG. 3.
Figure 6:
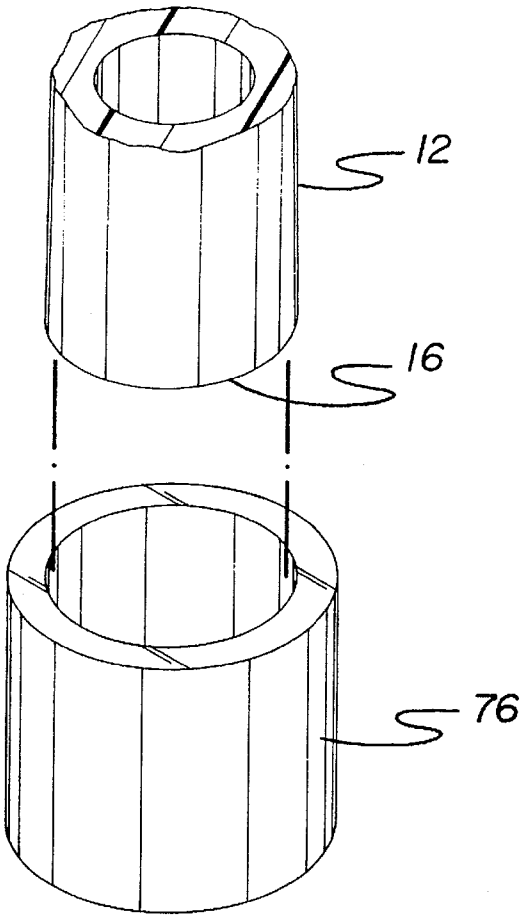
FIG. 6 is an exploded view of the rear portion of the present invention.

Specifically, the present invention includes an elongated cylindrical sleeve 12. The sleeve has a top end 14, a bottom end 16 and a circular cross section, as shown in FIG. 6. The sleeve may be formed of metal or plastic. Preferably, the sleeve is formed of a lightweight aluminum. The top end of the sleeve has an opening 18. The bottom end of the sleeve is sealed, as shown in FIG. 4. The sleeve has an oblong slot 22 that is spaced from the bottom end and along one side 24 of the sleeve. The sleeve has a length of about four feet four inches and an inner diameter of about three-fourths inch.

Figure 3:
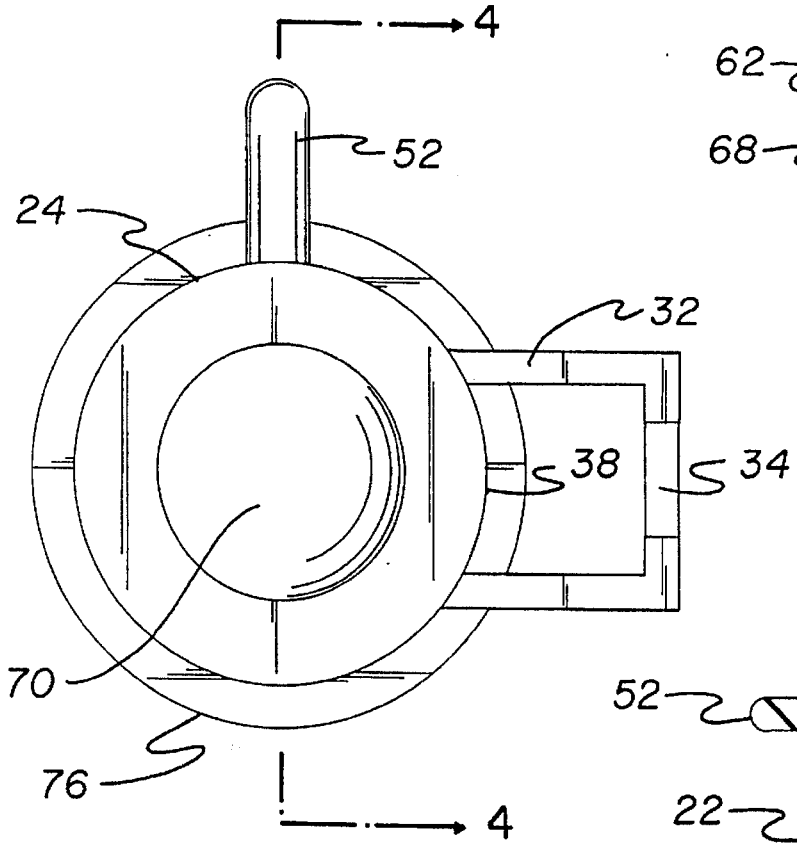
FIG. 3 is a top plan view of the present invention in an operable configuration.
Figure 5:
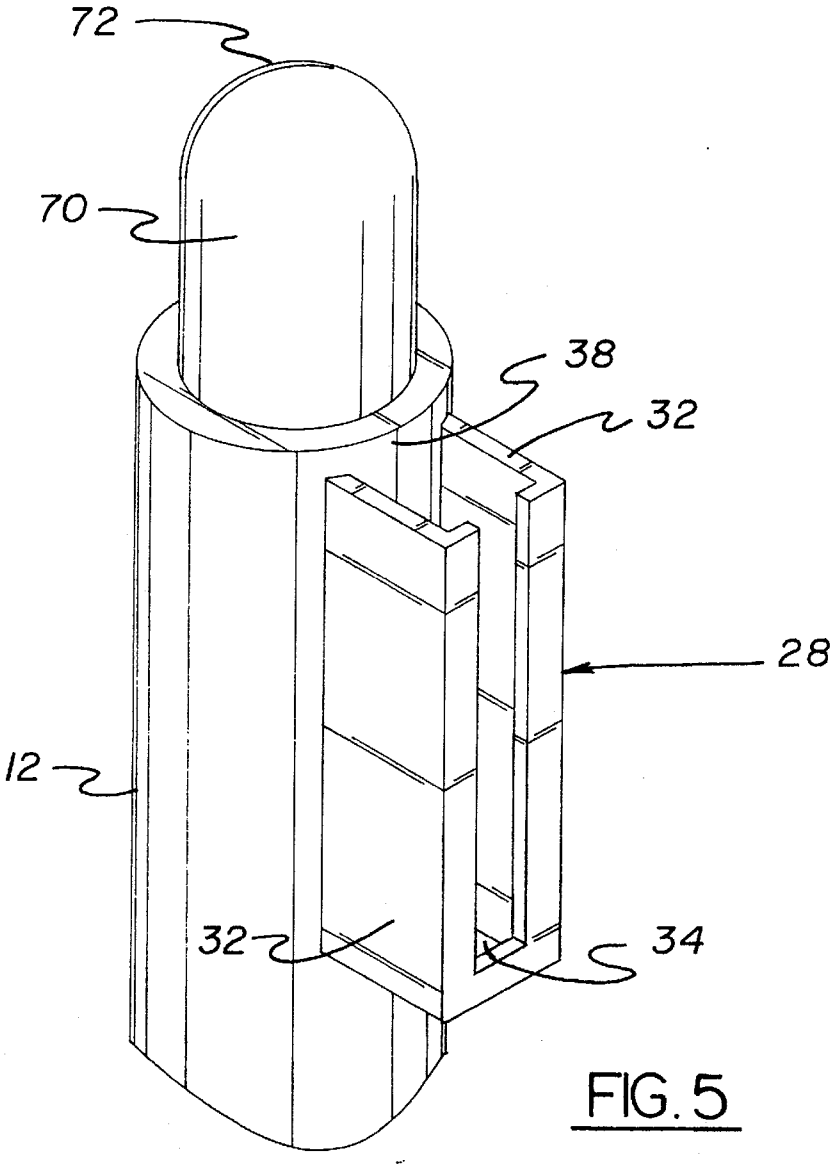
FIG. 5 is a fragmentary view of the top portion of the present invention.

Also, a generally rectangular holder 28 is provided. The holder has a pair of sides 32 interconnected by a base member 34 that is spaced from the top end, as shown in FIGS. 3 and 5. The base member seals the holder at the bottom. The holder is formed of the same material used to make the sleeve. The holder is fixedly attached to the sleeve by welding or machined thereon when the sleeve is formed.

The holder is adjacent the top end, and positionable on another side 38 of the sleeve 12, at a location other than diametrically opposed from the one side 24 that has the slot 22. The holder is capable of having a hanger 42 with a string 44 inserted, as shown in FIG. 1, for lifting the hanger and string above the head of a user of the sleeve 12. The string can have various articles 46 attached for suspending from the ceiling.

Figure 2:
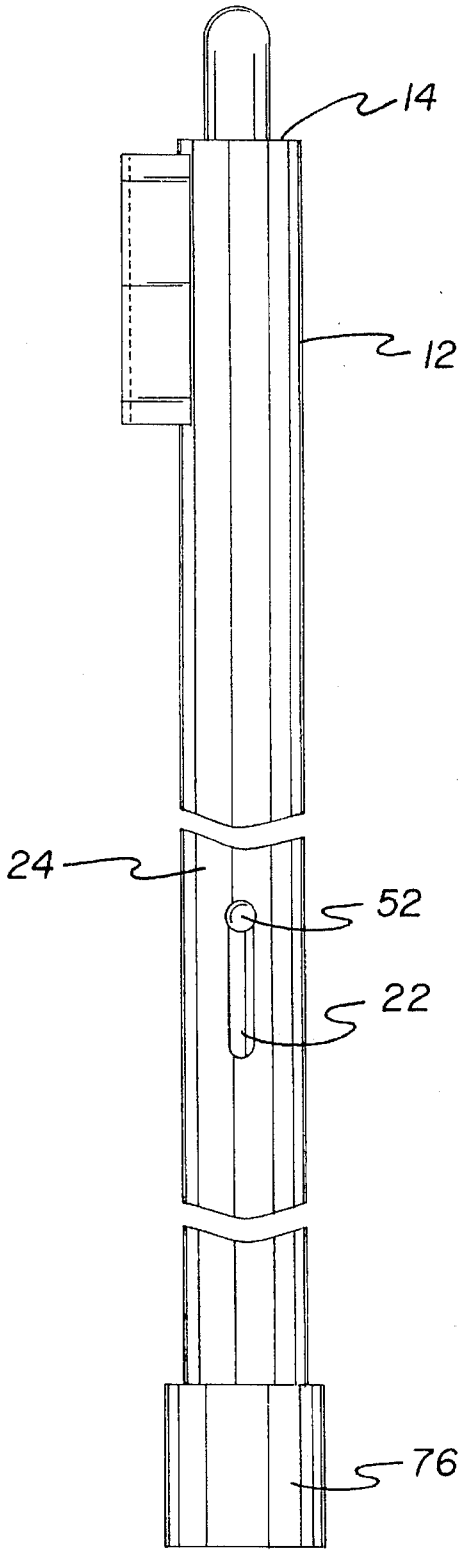
FIG. 2 is a vertical side view of the present invention in an operable configuration.

As best illustrated in FIG. 4, an elongated lift rod 48 is slidably positioned within the sleeve 12. The lift rod is a solid metal or plastic, preferably a metal or metal alloy. The lift rod has the same length as the sleeve, with a diameter of about one-third that of the inner diameter of the sleeve. The lift rod has a lever 52 that is fixedly attached near a bottom edge 54 of the lift rod. The lever, as shown in FIG. 2, is positioned through the slot 22 of the sleeve 12.

The lever moves the lift rod up and down within the sleeve. The lift rod has a top edge 56 that is capable of extending beyond the opening 18 of the sleeve. The top edge is extended when the lever causes the rod to slide up and down within the sleeve, and a top portion 62 is moved toward the opening. As the lever is pushed upward, a stop 66 prevents the lift rod from extending too far past the top end. The stop engages an interior shelf 68 of the sleeve, as seen in FIG. 4.

FIG. 5 shows a push tip 70 that has a semi-spherical or bulbous end 72. The push tip is fixedly attached to the top edge 56 of the lift rod, as shown in FIG. 4. The push tip is preferably formed of a flexible material. The material must be capable of sliding in and out of the opening 18, when the lever is pulled. The push tip is capable of lifting a tile of a tile ceiling, when the sleeve 12 with the rod, is raised. The push tip lifts the tile to allow the positioning of the hanger between a metal track of the tile ceiling. The push tip is capable of being retracted within the sleeve, when the lever is released, to allow the tile to return and be repositioned against the metal track. Also, the lift rod is able to retract the push tip automatically through the force of gravity and the weight of the push tip. The tile, when positioned against the metal track, is able to hold the hanger thereagainst and allow the string and article to be suspended. The stop 66 and the sleeve 68 keep the push tip from reaching too far pass the tile and becoming entangled with other structures.

Lastly, an end cap 76 is positioned over the bottom end 16 of the sleeve, as shown in FIG. 4. The end cap of FIG. 6, is formed of a flexible material that may have decorative colors. The end cap is for grappling by the hand of the user when turning the sleeve 90 degrees for placement of the hanger 42 onto the metal track.

The present invention is a hang-up for assisting in the hanging of objects from the track of a drop ceiling. The tool is designed to aid people who wish to suspend various articles from a ceiling, without using a chair. In use, a paper clip or manufactured hanger is placed in the holder of the tool. The paper clip or hanger has attached a string with an article. Once the hanger is placed in the holder, the tool is used to push a tile of suspended ceiling upwards. The push tip is placed against the tile and the user motions the sleeve upward. Once the tile is pushed upward, the tool is turned 90 degrees and the hanger is placed on the metal track of the ceiling. The tile is released by taking the lever and pulling downward on the lever to move the lift rod downward within the sleeve. The tool is easily manufactured and easy to store. The tool provides a safe way to display things from a suspended ceiling without the use of ladders, chairs and other items that people stand on.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A retractable pole for hanging objects for assisting in the hanging of objects from the track of a dropped ceiling comprising in combination:

an elongated cylindrical sleeve having a top end, a bottom end and a circular cross section, the top end of the sleeve having an opening therethrough, the bottom end of the sleeve being sealed, the sleeve having an oblong slot spaced from the bottom end and along one side of the sleeve;

a generally rectangular holder having a pair of sides with a base member interconnecting the sides, the holder being fixedly attached to the sleeve adjacent the top end, the holder positionable on another side of the sleeve at a location other than diametrically opposed from the one side having the slot thereon, the holder being capable of having a hanger with a string inserted therein for lifting of the hanger and string above the head of a user of the sleeve;

an elongated lift rod being slidably positioned within the sleeve, the lift rod having a lever fixedly attached thereto, the lever capable of being positioned through the slot of the sleeve, the lever being capable of moving the lift rod up and down within the sleeve, the lift rod having a top edge being capable of extending beyond the opening of the sleeve when the rod is slid up and down within the sleeve;

a push tip having a bulbous end and being fixedly attached to the top edge of the lift rod, the push tip being capable of lifting a tile of a tile ceiling when the sleeve with the rod therein is raised, the push tip lifting the tile for allowing the positioning of the hanger between a metal track of the tile ceiling, the push tip capable of being retracted within the sleeve when the lever is released for allowing the tile to return to be repositioned against the metal track to hold the hanger thereagainst; and an end cap positionable over the bottom end of the sleeve for grappling by a hand of the user when turning the sleeve for placement of the hanger onto the metal track.

2. A hang-up comprising:

a sleeve having a top end with an opening therethrough, a bottom end being sealed, and a slot spaced from the bottom end;

a holder having a pair of sides with a base member interconnecting and sealing the side at a bottom, the holder being fixedly attached to the sleeve adjacent the top end, and capable of having a hanger inserted therein;

a lift rod slidably positioned within the sleeve and having a lever capable of being positioned through the slot, the lever being capable of moving the lift rod and having a top edge for extending beyond the opening; and a push tip being fixedly attached to the top edge of the lift rod and capable of lifting a tile of a tile ceiling, when the sleeve is raised, for allowing the positioning of the hanger between a metal track of the tile ceiling.

3. The hang-up as set forth in claim 2 wherein the sleeve has a circular cross section with the slot being along one side of the sleeve.

4. The hang-up as set forth in claim 3 wherein the holder is positionable on another side of the sleeve and at a location other than diametrically opposed from the one side having the slot thereon.

5. The hang-up as set forth in claim 2 wherein the hanger when positioned on the holder is capable of having a string with another object thereon coupled thereto and the holder is capable of lifting the hanger and string above the head of a user of the sleeve.

6. The hang-up as set forth in claim 2 wherein the lever is fixedly attached to the lift rod and capable of moving the lift rod up and down within the sleeve, and allowing the top edge to move in and out of the opening when the rod is slid up and down within the sleeve.

7. The hang-up as set forth in claim 2 wherein the lift rod has a stop and the sleeve has an interior shelf for engaging the stop.

8. The hang-up as set forth in claim 2 wherein the push tip has a semi-spherical end and is capable of being retracted within the sleeve when the lever is released for allowing the tile to return to be repositioned against the metal track to hold the hanger thereagainst.

9. The hang-up as set forth in claim 8 wherein an end cap is positioned over the bottom end of the sleeve for grappling by a hand of the user when turning the sleeve for placement of the hanger onto the metal track.

* * * * *